United States Patent [19]

Capolupo

[11] 4,198,026

[45] Apr. 15, 1980

[54] FIREARM SECURITY DEVICE

[75] Inventor: Guy Capolupo, Riverdale, N.Y.

[73] Assignee: Anthony Saraniero, Ozone Park, N.Y. ; a part interest

[21] Appl. No.: 2,993

[22] Filed: Jan. 12, 1979

[51] Int. Cl.[2] ..... E05B 73/00

[52] U.S. Cl. ..... 248/552; 42/1 LP; 42/1 Y; 70/58; 70/DIG. 57; 211/4; 211/64

[58] Field of Search ..... 248/552, 553, 551; 211/4, 8, 64; 42/70 E, 70 C, 1 Y, 1 LP; 70/57, 58, 61, DIG. 57; 224/42.25, 243, 244

[56] References Cited

U.S. PATENT DOCUMENTS

| | | | |
|---|---|---|---|
| 2,742,726 | 4/1956 | Feller | 42/70 E |
| 2,893,152 | 7/1959 | Peluso | 42/70 E |
| 3,031,787 | 5/1962 | Womble, Jr. | 42/70 E |
| 3,422,560 | 1/1969 | Foote et al. | 42/70 E |
| 3,637,180 | 1/1972 | Parry | 248/553 |
| 3,990,618 | 11/1976 | Shattuck | 224/42.25 X |
| 4,050,662 | 9/1977 | Pickering | 42/1 Y X |
| 4,076,158 | 2/1978 | Barr | 248/552 |

*Primary Examiner*—William E. Lyddane
*Attorney, Agent, or Firm*—Kenyon & Kenyon

[57] ABSTRACT

A security device for safely storing firearms is disclosed. When a firearm is locked to the device, removal of the firearm from the device and removal of the device from the mounted structure are prevented. In the preferred embodiment, the device comprises a disc-like base member, two rods secured to the base member and extending therefrom, a disc-like covering member having two holes therein into which the two rods are inserted and from which they extend, and a hole in the end of one of the rods for receiving the shackle of a padlock. The firearm is secured to the device by placing it on the device with the trigger guard extending about the two rods and the trigger disposed between the two rods. The padlock is then attached to the device to prevent withdrawal of the firearm. The firearm can not be discharged since the trigger is prevented from moving by the two rods. The covering member prevents removal of the device from a wall or a locker, for example.

11 Claims, 4 Drawing Figures

Fig. 2.
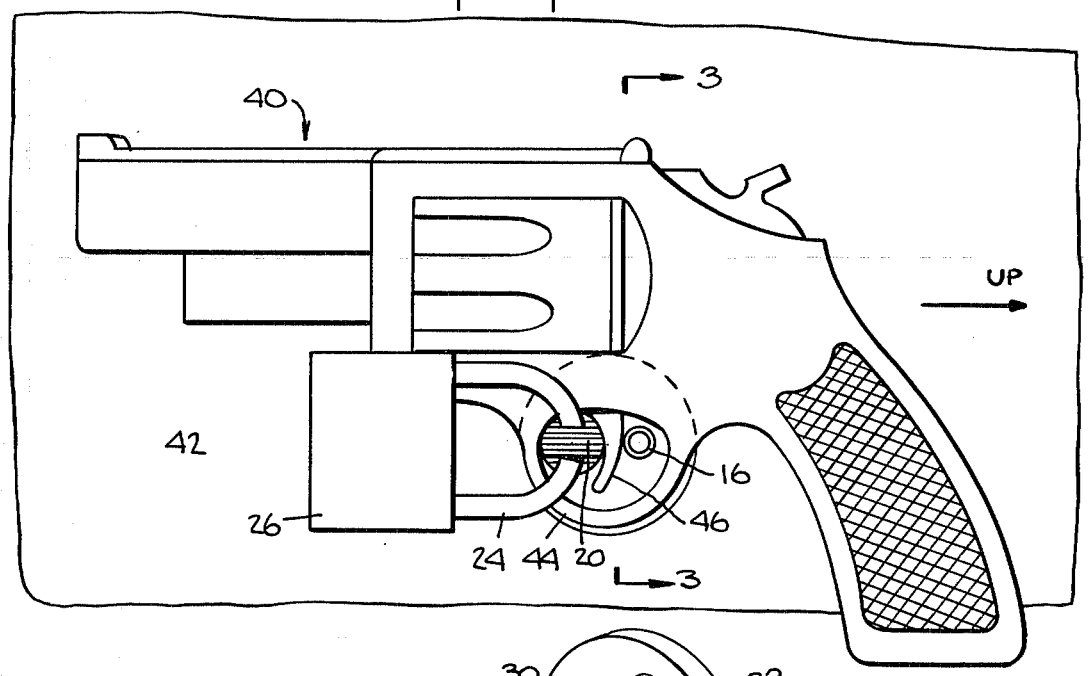
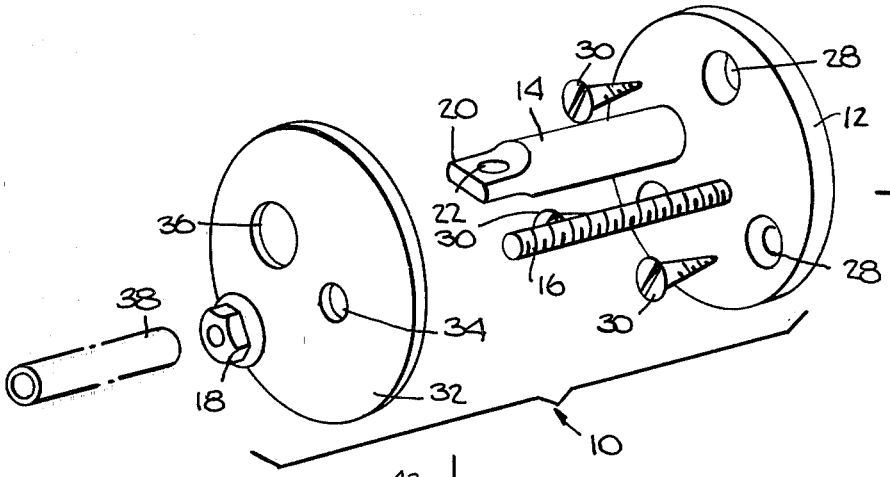
Fig. 1.
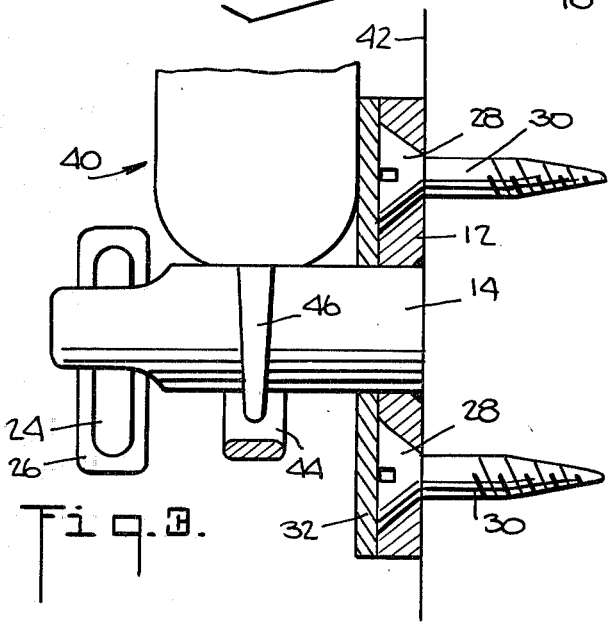
Fig. 3.
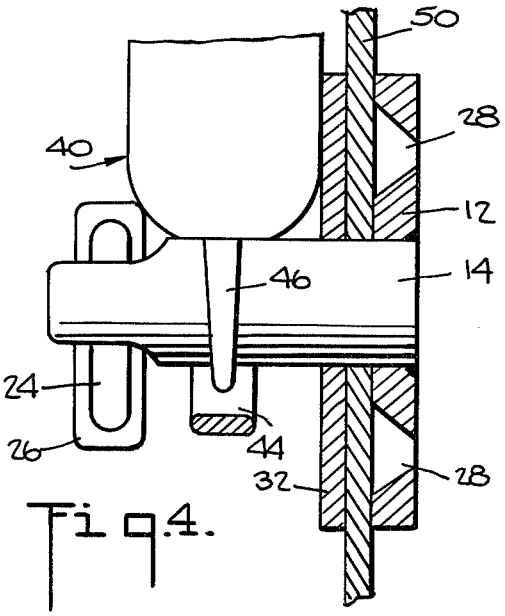
Fig. 4.

FIREARM SECURITY DEVICE

BACKGROUND OF THE INVENTION

The present invention relates to a security device for storing a firearm and more particularly to a security device for storing a handgun while preventing its discharge.

Firearms, particularly handguns, should be stored so that they cannot be removed without authorization and in such a manner as to prevent unauthorized or accidental discharge of the firearm should the firearm remain loaded for any reason.

SUMMARY OF THE INVENTION

It is accordingly an object of the present invention to provide a security device for a firearm which prevents unauthorized removal of the firearm.

It is also an object of the present invention to provide a security device for a firearm which prevents unauthorized or accidental discharge of the firearm.

It is another object of the present invention to provide a security device for a firearm which both prevents unauthorized removal of the firearm while preventing its unauthorized or accidental discharge.

It is still another object of the present invention to provide a security device for a firearm which prevents unauthorized removal of the firearm, prevents unauthorized or accidental discharge of the firearm, and provides a secure mounting of the security device to a structure having either a single exposed surface or two exposed surfaces.

It is yet another object of the present invention to provide a security device for a firearm which may be mounted to a structure having a single or two exposed surfaces and which prevents unauthorized removal of the firearm and the security device from the structure.

These and other objects of the present invention are achieved by a firearm security device having a base member and a covering member according to the invention in which the covering member prevents unauthorized removal of the base member with the firearm secured to the security device from a mounting structure, or the covering and base members cooperate with the mounting structure to prevent unauthorized removal of the security device with the firearm secured thereto from the mounting structure. In accordance with the invention two elongated members are secured to and extend from the base member and are adapted to receive the firearm and to prevent discharge of the firearm. The firearm trigger guard is placed about the two elongated members and the firearm trigger is disposed between the two elongated members. The space between the two elongated members either substantially prevents movement of the trigger or is insufficient to permit cocking and release of the firing mechanism of the firearm to thereby prevent discharge of the firearm. Locking means associated with at least one of the elongated members are provided to prevent withdrawal of the trigger guard from about the elongated members and the security device and to prevent removal of the covering member, thereby securely locking the firearm and security device to the mounting structure.

Further in accordance with the invention, the firearm security device comprises a generally plate-like base member to which first and second elongated members are secured and from which they extend in a spaced, generally parallel relationship. A generally plate-like covering member having at least one opening therethrough is provided to slidably receive the first and second elongated members therein so that the covering member may be slid towards the base member to be positioned next to the base member with the first and second members extending through the covering member, while the covering member covers at least a portion of the base member. The first and second members are spaced and sized so that the trigger guard of a firearm can be disposed thereabout with the trigger of the firearm disposed between the first and second members, the first and second members extending through the trigger guard. Locking means are secured to the free end of one of the first and second members to prevent removal of the firearm from the security device, the locking means preventing withdrawal of the trigger guard from about the first and second members. Fastening means are preferably provided to fasten the covering member to the remainder of the security device.

In the preferred embodiment, the base and covering members are disc-like plates, each of the first and second elongated members are rods extending at approximately right angles from the base member, and the covering member has two openings, one for each of the rods. Fastening means are provided for removably fastening the covering member to the remainder of the device and preferably comprise threads on one of the rods and a nut threadedly received by that rod. The locking means for preventing withdrawal of the firearm preferably comprise an opening through the end of one of the rods which is adapted to receive a locking device such as a padlock.

The firearm security device according to the invention is adapted to be mounted to a structure having two exposed surfaces such as a locker or a structure having a single exposed surface such as a wall. When mounted to a locker, the base member is placed on the exterior of the locker with the two rods extending through holes in the locker wall into the interior of the locker. The covering member is placed on the device with the rods extending therethrough in the interior of the locker and positioned to sandwich the locker wall between the base and covering members. A nut received by one of the rods is used to tighten the covering member to the security device to securely sandwich the locker wall. The firearm may then be disposed on the two rods with the trigger guard extending thereabout and a padlock secured to prevent withdrawal of the firearm from the security device as well as preventing removal of the covering member so that the security device itself cannot be removed from the locker. When the security device is mounted to a wall, a plurality of screw holes are provided in the base member and the base member is screwed into the wall. The covering member is then placed onto the security device with the rods extending therethrough and positioned adjacent the base member to cover the screw holes and the screws extending therethrough which fasten the base member to the wall. The firearm is then placed on the security device and locked thereon as described above for mounting in a locker. The covering member denies access to the screws in the base member so that the device cannot be removed. In each mounting embodiment, the trigger of the firearm is disposed between the rods to prevent discharge of the firearm. When the security device is mounted to a generally vertically extending surface, the rods extend generally horizontally and support the firearm. When the security device is mounted to a generally horizontally extending surface, the rods extend generally vertically and the firearm rests on the covering member or is supported by the locking means.

These and other aspects of the present invention will be more apparent from the following description of the preferred embodiments thereof when considered with the accompanying drawings.

BRIEF DESCRIPTION OF THE DRAWINGS

The present invention is illustrated by way of example and not limitation in the figures of the accompanying drawings in which like numerals indicate similar parts and in which:

FIG. 1 is an exploded perspective view of the firearm security device according to the invention;

FIG. 2 is a side elevation view of the firearm security device according to the invention mounted to a wall structure and supporting a handgun which is locked to the device;

FIG. 3 is a section view taken along lines 3—3 of FIG. 2; and

FIG. 4 is a section view similar to that of FIG. 3 showing the device according to the invention mounted to a locker wall.

DESCRIPTION OF THE PREFERRED EMBODIMENTS

Referring more particularly now to the drawings, the firearm security device according to the invention for securing a handgun is illustrated. As shown in FIG. 1, the device 10 comprises a metal disc-like base member or plate 12 to which metal rods 14 and 16 are secured by welding, for example. Alternatively, the base member and rods may be formed as a unitary piece by casting, for example. Rod 16 is threaded and is adapted to receive nut 18 thereon. Rod 14 includes a section 20 of reduced diameter at the free end thereof with a hole 22 extending through the reduced diameter section. The hole 22 is adapted to receive the shackle 24 of a padlock 26 (key or combination) as shown in FIG. 2. The base member also includes a plurality of countersunk holes 28 which are adapted to receive screws 30 when the device 10 is mounted to a structure having a single exposed surface such as a wall, as shown in FIGS. 2 and 3 and described hereinafter. While three holes 28 are illustrated and which have been found suitable to securely mount the device 10 to a wall, two, four or more holes may be employed to mount the device 10 to a wall.

A metal disc-like covering member or plate 32 of approximately the same size as base plate 12 having holes 34, 36 is provided to cooperate with the base plate and the padlock to prevent removal of the device with a handgun locked thereto. The holes 34 and 36 are sized to slidably receive the rods 16 and 14, respectively, and the covering plate 32 is slid onto the rods 16 and 14 and positioned proximate base plate 12. A plastic sleeve 38 is provided to be inserted over the threaded rod 16 so that the threads of the rod will not come into contact with the firearm and mar the finish of the firearm.

As shown in FIGS. 2 and 3, the firearm security device 10 can be utilized to secure a handgun 40 to a structure having a single exposed surface such as a wall 42. The device is mounted to the wall surface by positioning the base plate 12 adjacent to the wall surface and securing the base plate 12 to the wall surface by means of screws 30. The base plate 12 is preferably secured to a structural element such as a beam in the wall. If the base plate 12 must be secured solely to a plaster wall or a plasterboard wall, fasteners such as toggle bolts are used instead of screws 30. After the base plate 12 has been secured to the wall surface, the covering plate 32 is disposed on the rods 16 and 14 in contact with the base plate 12. The nut 18 secures the covering plate 32 against the base plate 12 and covers the screw holes 28 and screws 30 so that they are inaccessible. The handgun 40 is then placed on the device 10 with rods 14 and 16 extending through the trigger guard 44 of the handgun and the trigger 46 of the handgun disposed between the rods 14 and 16. In FIG. 2, the wall surface extends vertically and the rods extend horizontally. The rods preferably support the handgun with the handle in the upper vertical position and the barrel pointing downwardly for safety. While the device may be used to secure almost any firearm having a trigger guard and lever-type trigger, a handgun is used for purposes of illustration. The thicknesses of rods 14 and 16 and the spacing therebetween are selected so that the rods will extend through the trigger guard while leaving sufficient space for the trigger to be disposed between the rods. Additionally, the size and spacing of the rods are such that substantial movement of the trigger is prevented by the spacing between the rods and the spacing between the trigger guard and the rods, to thereby prevent unauthorized or accidental discharge of the handgun.

The handgun is secured by locking a padlock 26 to the device 10. This is done by inserting the shackle 24 of the padlock through the hole 22 in rod 14 and then locking the padlock. The padlock prevents withdrawal of the handgun from the device 10. Since the handgun cannot be withdrawn from the device and since the trigger is substantially prevented from being moved, the handgun is secure against theft and discharge. Additionally, since the handgun cannot be withdrawn, the covering plate 32 cannot be withdrawn, thereby preventing access to the screw holes 28 and screws 30. Accordingly, the device and handgun can be securely mounted to a wall.

Referring now to FIG 4, the handgun 40 can be securely mounted to a structure having two exposed surfaces such as a locker. When the device is mounted to a locker wall 50, the device need not include holes 28 for screws. However, for uniformity and ease of production, the device may include the holes although they are not employed. To mount the device to a locker wall, two holes are drilled in the locker wall to permit insertion of rods 14 and 16 from the outside of the locker into the interior of the locker. Base plate 12 is disposed on the exterior surface of the locker with the rods 14 and 16 extending into the interior of the locker. The covering plate 32 is then placed on the rods 14 and 16 and butted up against the interior surface of the locker wall 50. The nut 18 is then tightened on to the rod 16 to snugly sandwich the locker wall 50 between the base plate 12 and the covering plate 32. The handgun is then mounted on the rods 14 and 16 as described for the wall-mounted embodiment of FIGS. 1-3.

As mentioned, the device 10 may be utilized to secure firearms having a trigger guard and a lever-type trigger and can secure rifles as well as handguns. However, the device is particularly adapted to secure handguns. For example, in the home, the device may be disposed within a closet and securely mounted to a closet wall. The firearm will remain accessible yet it will be out of sight and securely and safely stored. The device also is quite useful in police stations and armories where one desires to temporarily and safely secure his handgun without unloading it, in a locker, for example. Thus, if one does not desire to wear his handgun while he is performing certain duties, for example, office duties, he may temporarily and safely secure his handgun in his locker and need not unload the handgun since discharge is prevented.

The advantages of the present invention, as well as certain changes and modifications of the disclosed embodiments thereof will be readily apparent to those skilled in the art. It is the applicant's intention to cover by his claims all those changes and modifications which could be made to the embodiment of the invention herein chosen for the purpose of the disclosure without departing from the spirit and scope of the invention.

What is claimed is:

1. A firearm security device comprising a generally plate-like base member;

a first elongated member secured to and extending from the base member;

a second elongated member secured to and extending from the base member generally parallel to and spaced from the first member;

a generally plate-like covering member having at least one opening therethrough sized to slidably receive the first and second members, the covering member being adapted to be positioned proximate to the base member with the first and second members extending therethrough;

the first and second members being spaced and sized and adapted to receive the trigger guard of a firearm thereabout and the trigger of the firearm therebetween, the first and second members being adapted to extend within the trigger guard at least one of the first and second members being adjacent the trigger guard to limit substantial movement of the device relative to the trigger guard, and at least one of the first and second members extending from the base member a distance sufficient to extend beyond the trigger guard; and means associated with the member extending beyond the trigger guard for preventing the withdrawal of a firearm disposed with its trigger guard extending about the first and second members and its trigger located between the first and second members.

2. The device as recited in claim 1, wherein the covering member has two openings, one for the first member and another for the second member.

3. The device as recited in claim 1, wherein the device includes fastening means for removably fastening the covering member to the base member and the first and second members.

4. The device as recited in claim 3, wherein the second member is a rod and the fastening means comprise threads on the rod and a nut threadedly received by the threaded rod.

5. The device as recited in claim 1, wherein the first member is a rod and the means preventing withdrawal of a firearm comprise an opening through the rod adapted to receive a locking means.

6. The device as recited in claim 1, wherein the base and covering members are disc-like plates.

7. The device as recited in claim 1, wherein the first and second members extend from the base member at approximately a right angle thereto.

8. The device as recited in claim 1, wherein the base member has a plurality of through holes adapted to receive fastening means for fastening the base member to a surface and the covering member is sized to cover the holes when the covering member is positioned adjacent to the base member.

9. The device as recited in claim 1, wherein the first and second members are sized and spaced and adapted to prevent discharge of a firearm disposed on the device with firearm trigger guard extending about the first and second members and the firearm trigger positioned between the first and second members.

10. The device as recited in claim 1, wherein the base member and the first and second members are metal and the first and second members are secured to the base member by welding.

11. The device as recited in claim 1, wherein the base member and the first and second members are integrally formed as a unitary piece.

* * * * *